US011259641B2

(12) United States Patent
Schramm et al.

(10) Patent No.: US 11,259,641 B2
(45) Date of Patent: Mar. 1, 2022

(54) SYNCHRONIZATION OF MOTION FURNITURE WITH MULTIPLE ACTUATORS

(71) Applicant: L&P PROPERTY MANAGEMENT COMPANY, South Gate, CA (US)

(72) Inventors: Oliver J. Schramm, Kernersville, NC (US); David Purser, Carthage, MO (US); Ronald D. Davis, Joplin, MO (US); Caleb Browning, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 198 days.

(21) Appl. No.: 16/748,324

(22) Filed: Jan. 21, 2020

(65) Prior Publication Data

US 2020/0237104 A1 Jul. 30, 2020

Related U.S. Application Data

(60) Provisional application No. 62/796,801, filed on Jan. 25, 2019.

(51) Int. Cl.
*A47C 17/04* (2006.01)
*A47C 31/00* (2006.01)
(Continued)

(52) U.S. Cl.
CPC ..... *A47C 17/04* (2013.01); *A47C 21/003* (2013.01); *A47C 31/008* (2013.01); *A47C 7/725* (2013.01); *A47C 17/86* (2013.01)

(58) Field of Classification Search
CPC ..... A47C 17/00; A47C 17/04; A47C 21/00; A47C 21/003; A47C 31/00; A47C 31/008; A47C 17/86
See application file for complete search history.

(56) References Cited

U.S. PATENT DOCUMENTS 7,321,811 B1 * 1/2008 Rawls-Meehan .... A47C 27/082 700/302
8,608,240 B2 12/2013 Marshall et al.
(Continued)

OTHER PUBLICATIONS

"International Search Report and Written Opinion Issued in PCT Application No. PCT/US20/14602", dated Apr. 14, 2020, 10 Pages.
(Continued)

*Primary Examiner* — Fredrick C Conley
(74) *Attorney, Agent, or Firm* — Shook, Hardy & Bacon L.L.P.

(57) ABSTRACT

Aspects herein are directed to systems and methods for synchronization of actuators to reposition furniture units. Specifically, a master control box receives input to reposition a furniture unit from one position to another and communicates the input to a plurality of control boxes. Then, each of the plurality of control boxes assigns a virtual axis to each of a plurality of actuators attached to each associated control box. Furthermore, each of the plurality of control boxes assigns a transfer function to each of the plurality of actuators. The transfer function is used by the actuators to transform an output of the virtual axis to determine a target position. In this way, the plurality of actuators can reference the same virtual axis for synchronization purposes, but use different transfer functions to maintain complex relationships between the positions of each actuator. Based on the target position, the actuators reposition the furniture unit.

20 Claims, 8 Drawing Sheets

(51) Int. Cl.

| | |
|---|---|
| ***A47C 21/00*** | (2006.01) |
| *A47C 17/86* | (2006.01) |
| *A47C 7/72* | (2006.01) |

(56) References Cited

U.S. PATENT DOCUMENTS

| | | | | |
|---|---|---|---|---|
| 9,241,571 | B2 | 1/2016 | Robertson | |
| 10,390,620 | B2 | 8/2019 | Labrosse et al. | |
| 10,449,101 | B2 * | 10/2019 | Brosnan | A61G 7/0524 |
| 2008/0262657 | A1 * | 10/2008 | Howell | A47C 31/008 700/275 |
| 2009/0100599 | A1 * | 4/2009 | Rawls-Meehan | A61G 7/018 5/616 |
| 2012/0193946 | A1 | 8/2012 | Robertson | |
| 2013/0062914 | A1 | 3/2013 | Marshall | |
| 2017/0112716 | A1 | 4/2017 | Rawls-Meehan | |
| 2018/0360218 | A1 | 12/2018 | Labrosse et al. | |

OTHER PUBLICATIONS

International Preliminary Report on Patentability received for PCT Application No. PCT/US2020/014602, dated Aug. 5, 2021, 9 pages.

* cited by examiner

SYNCHRONIZATION OF MOTION FURNITURE WITH MULTIPLE ACTUATORS

CROSS-REFERENCE TO RELATED APPLICATIONS

This application, having attorney docket number 18101.323320 and entitled "Synchronization of Motion Furniture with Multiple Actuators" is a U.S. Non-Provisional application claiming priority to U.S. Provisional Patent Application No. 62/796,801, entitled "Synchronization of Motion Furniture with Multiple Actuators," filed Jan. 25, 2019. The entirety of the aforementioned application is incorporated by reference herein.

FIELD OF INVENTION

The present invention relates broadly to motion furniture, and more particularly, to motion furniture designed to support various activities, such as seating (e.g., recliners, stools, sofas), working (e.g., desks), and eating (e.g., tables). Motion furniture includes recliners, lift recliners, incliners, sofas, love seats, sectionals, theater seating, ottomans, traditional chairs, chairs with a moveable seat portion, motion desks, adjustable beds, split adjustable beds, smart beds, and other such furniture pieces. Such furniture pieces are referred to herein generally as "furniture unit(s)." More specifically, the present invention relates to an improved synchronization system developed to accommodate a wide variety of complex motion furniture (e.g., motorized furniture) containing a plurality of actuators that act collectively to move (i.e., reposition) a furniture unit or a portion thereof. Such improvement in the synchronization of actuators utilized by the motion furniture industry is otherwise limited by existing configurations of actuators in the field. It would be advantageous to have a synchronization method adapted to overcome the challenges presented by such limitations.

SUMMARY

Accordingly, one aspect of the present disclosure relates to simplified, improved, and universal systems and methods that enable the synchronization of actuators to reposition furniture units, particularly when the actuators are not in an equal relationship to one another. In this regard, an input (e.g., command) to reposition a furniture unit from a first position to a second position is received at a master control box. The master control box communicates the command to a plurality of control boxes over a communication bus and/or a network of communication busses. Each one of the plurality of control boxes assigns a virtual axis to each of a plurality of actuators attached to each associated control box. Each one of the plurality of control boxes assigns a transfer function to each of the plurality of actuators attached to each associated control box. The transfer function is used by the actuators to transform an output of the virtual axis to determine a target position. In this way, a plurality of actuators can reference the same virtual axis for synchronization purposes, but use different transfer functions to maintain complex relationships between the positions of each actuator. The target position denotes where each actuator must move to in order to reach the second position. The target position may be the same value or different values for each actuator. Based on the target position, the actuators reposition the furniture unit from the first position to the second position.

This summary is provided to introduce a selection of concepts in a simplified form that are further described below in the detailed description. This summary is not intended to identify key features of essential features of the claimed subject matter, nor is it intended to be used as an aid in determining the scope of the claimed subject matter.

BRIEF DESCRIPTION OF THE SEVERAL VIEWS OF THE DRAWINGS

The present disclosure is described in detail below with reference to the attached drawing figures, wherein.

DETAILED DESCRIPTION OF THE INVENTION

Overview

Figure 1:
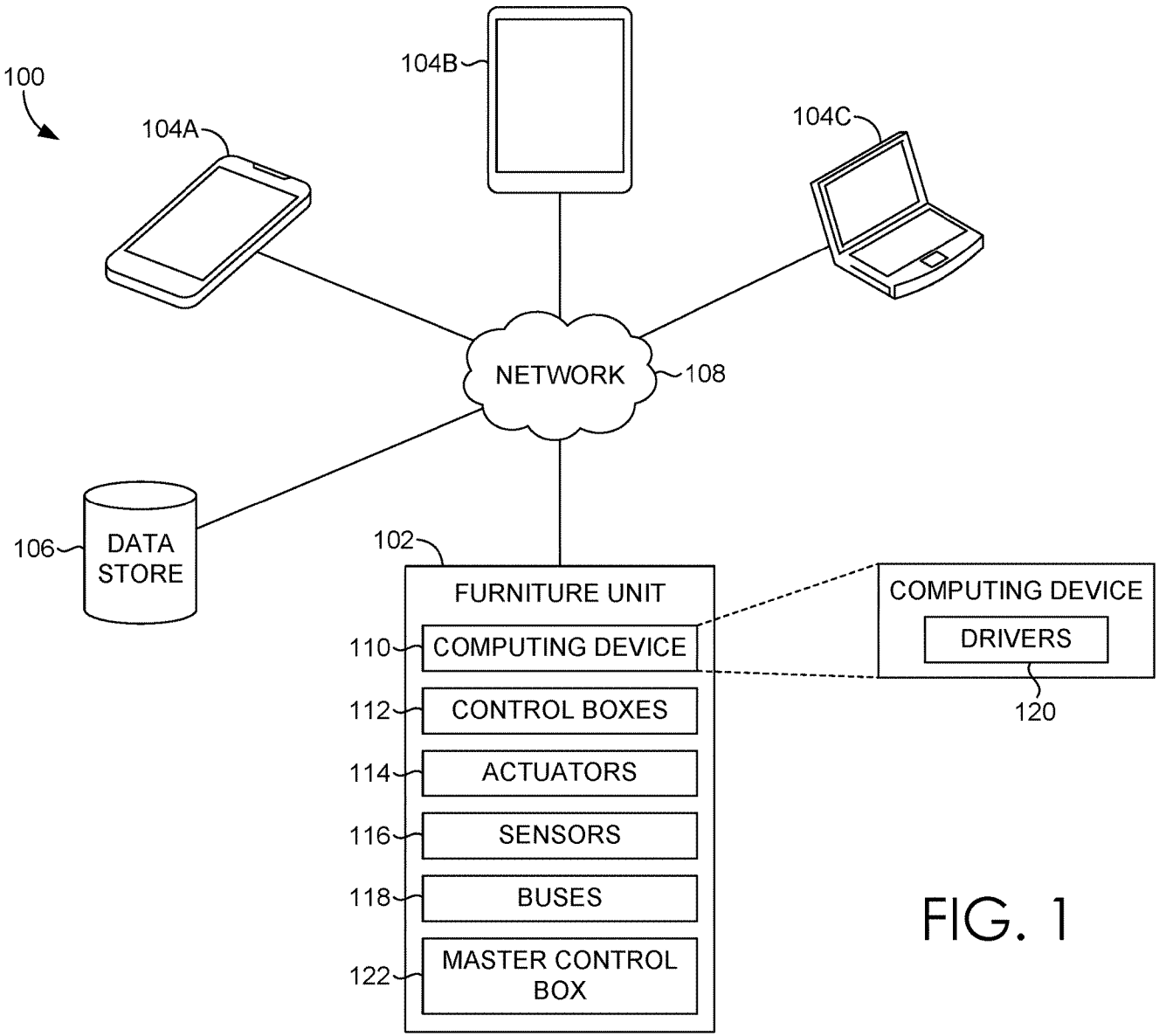
FIG. 1 is schematic depiction of a synchronization system for repositioning furniture units using synchronized actuators, in accordance with embodiments of the present disclosure.

Motion furniture is common in the furniture industry. Typically, motion furniture provides a personalized (e.g., comfortable, efficient, functional) user-furniture interaction. Mechanisms of the invention enable a user, for example, to adjust (i.e., reposition) a furniture unit, or a portion thereof, from a first position to second position. Oftentimes, a furniture unit can be adjusted or repositioned into many different and/or alternative positions. By way of example only, a user of a motorized standing desk may prefer in one instance to position the desk height at a lower position ideal for working in a seated position, but in another instance may prefer to reposition the desk height to a higher position ideal for working in a standing position. Additionally, a user of an adjustable bed may in some cases desire to sleep in a horizontal (e.g., flat) position, but in other cases may wish to reposition the bed to sleep at an angled position.

To accomplish such repositioning, furniture units may include an actuator (e.g., an electric motor), that functions, oftentimes in response to receiving an input (e.g., command, signal, detection of occupancy, etc.), to adjust (i.e., reposition) the furniture unit (e.g., standing desk) or a portion thereof (e.g., headrest portion of a chair) to an alternative position. When more than one actuator is required to reposition a furniture unit, or a portion thereof, the actuators of the present invention may maintain a particular relationship with each other to avoid damaging (e.g., binding) the furniture or causing malfunction. Generally, the relationship between actuators in motion furniture is an equality relationship, meaning each actuator must remain synchronized with the other actuators at all times (e.g., must remain synchronized before, during, and after repositioning). By way of nonlimiting example, upon receiving an input to reposition the legs of a standing desk, it is important that the actuators contained within each leg move at the same speed, at the same time and to the same position to ensure the desk remains level. After repositioning, the actuators should remain synchronized to ensure the repositioned desk remains level and at the desired position. A control mechanism (e.g., a controller, control box, etc.) may be used to enforce and maintain the equality relationship between actuators before, during, and after the repositioning processes.

In some cases, however, the relationship between actuators is more complex due to furniture unit design. For example, a furniture unit may consist of two linear actuators mounted in opposing directions—one front-to-back, the other back-to-front. As one of the actuators extends (i.e., its position increases), the other actuator retracts (i.e., its position decreases). In such an example, the relationship between the actuators is more complex (e.g., inverse rather than equal) due to the complexity of the furniture unit design. As the complexity of the functionality of motion furniture increases, the complexity of the relationships (i.e., the synchronization) between actuators also increases (e.g., quadratic, inverse square, sinusoidal, and the like) and the more difficult it becomes to maintain actuator synchronization to prevent furniture unit damage and malfunction. Traditional control box and actuator configurations are unable to enforce and maintain such complex relationships. There is an increased need for better actuator control capability for enforcing and maintaining the many different relationships between actuators in motion furniture. Therefore, a method of synchronization is necessary to ensure any relationship between actuator positions can be enforced.

Additionally, most conventional control boxes use separate versions of firmware to support different furniture units. By way of example only, one recliner may require the headrest actuator to be sequenced with the recline actuator for mechanical reasons, while another recliner may not have that requirement. Traditionally, the firmware of the control box must be modified to make this change. The manufacturer of the control box is generally responsible for this and will have to manage many different variants of firmware to support different products, different customers, and different furniture original equipment manufacturers ("OEMs").

This causes problems such that when an update must be made to add new functionality or resolve a problem to conventional systems, the update must be made to every variant of the firmware, and the involvement of the control box manufacturer is required to make each change to the firmware. Each variant must then be compiled, tested, packaged, distributed to the customer/furniture OEM (where it may be tested again), and included in the manufacturing process (which differs for each).

Accordingly, embodiments of the present disclosure relate to enhanced and/or improved systems and methods that enable the synchronization of actuators to reposition motorized furniture units. Additionally, by including advanced configuration and scripting options in the firmware of the control box, all manufactured control boxes can use a single unified firmware which supports all products, customers, and furniture OEMs. No variants are required, which greatly simplifies testing and distribution. Furthermore, a control box manufacturer does not need to be responsible for each change. If the customer or furniture OEM requires a change to the synchronization options, limits, or actuator sequencing, for example, they can make that change on their own without involvement of the control box manufacturer. This gives the customer or furniture OEM additional autonomy and flexibility to use the control box how they desire. It also reduces the required burden of continued development and support on the control box manufacturer.

In this regard, one or more control boxes may installed in a furniture unit. One of the control boxes is assigned to be the master control box. In some embodiments, the determination of which control box is assigned as the master control box may be done automatically based on software negotiation between the control boxes over a communication bus. In other embodiments, the determination of which control box is assigned as the master may be done manually, for example, at the time of manufacture. Various actuators are connected to the control boxes. Actuators may also be connected to the master control box. Communication busses connect the control boxes together and connect the control boxes to the master control box. In some embodiments, the communication bus may be a Controller Area Network ("CAN") bus. The master control box maintains the current linear position of each virtual axis of motion in the furniture unit. The master control box also coordinates (e.g., communicates) commands for each virtual axis via the communication busses.

Each actuator connected to a control box or the master control box is assigned to a virtual axis via software configuration of the control box. Further, each actuator is assigned a "transfer function." The transfer function transforms the output of the virtual axis into a target position for that specific actuator. In this way, multiple actuators can reference the same virtual axis for synchronization purposes, but use different transfer functions to maintain complex relationships between the positions of various actuators.

At runtime, an input (e.g., command) to reposition a furniture unit from a first position to a second position is received at a master control box. The input (e.g., command to move at least one virtual axis to a new position) may be communicated to the master control box from various sources, including external sources (e.g., buttons on the furniture unit, Bluetooth remotes, phone and/tablet applications, home automation systems, Wi-Fi devices, and the like). The input may further be communicated to the master control box by internal sources (e.g., based on furniture occupancy, user detection, Bluetooth device proximity, Wi-Fi device proximity, and the like).

As the virtual axis is commanded on the master control box, based on the input, to move to a second (e.g., alternative) position, the master control box communicates updated virtual axis parameters to the other control boxes via the communication bus. In embodiments, the updated virtual axis may also be communicated locally (i.e., within the master control box) to those actuators that are directly attached to the master control box.

Based on determining the target positions, the actuators synchronously reposition the furniture unit from the first position to the second position. In embodiments, each control box may use various methods of actuator control to move the actuator to the target position to complete furniture unit reposition. For example, some control boxes may use actuators with Hall sensors to measure position, and a position PID loop to determine the appropriate power output to the actuator to reach the target position; other control boxes may use an encoder to measure the position, or use a velocity PID loop instead of a position PID loop. However, if all control boxes in the system are capable of reaching and maintaining an accurate second (e.g., alternative) position, the system will remain synchronized. Advantageously, this means that the control boxes may be powered with different power supplies/voltages, or the actuators may have differing loads, without affecting the synchronization.

In embodiments where a control box is connected to the system and the position of at least one actuator connected to that control box is not known, all actuators assigned to that axis are commanded to a reference position so that the axis position can be reset to a known value. In further embodiments where synchronization communication is in progress between multiple control boxes and one of the control boxes is disconnected, the master control box will detect this "desynchronization" event and disable further movement until the system is reset or resynchronization is possible. In even further embodiments where one or more actuators cannot reach the target speed as communicated by the virtual axis, the control boxes will communicate and negotiate a lowered speed to continue operation without desynchronization.

In some embodiments, other sources may be used to control (e.g., command; transmit an input) a master control box. By way of example only, signals from external sources (e.g., security system, fire alarm, phone, etc.) or internal sources (e.g., wake-up alarm, real time clock) can be used by the control box to control various features within a furniture unit. Some of those features include, but are not limited to: (1) activate massage motors: each control box can drive multiple massage motors (and more than two can be connected with a multi-control box system); (2) operate actuators: a recliner, for example, may close an ottoman automatically in the event of a fire alarm, to accelerate evacuation of a theater, (3) activate buzzer: the control box has a buzzer capable of producing multiple tones; (4) activate lighting: the control box has a Red-Green-Blue ("RGB") Light Emitting Diode ("LED") driver which may be used to flash emergency lighting or illuminate aisles; and (5) send external commands: the control box may be connected to a cloud service which passes the alarm to other services, including home automation systems, text message alerts, etc.

In embodiments, the control box firmware is user-updateable through over-the-air ("OTA") (e.g., Wi-Fi) updates. In this regard, any user, customer, or furniture OEM can download the latest firmware image from the internet and update the control box (or this process can also be performed automatically, or with a cable). The update will be installed without overwriting their existing configuration and scripting, so that they receive the benefits of new functionality or resolved problems without a custom variant of firmware.

In other embodiments, the control box may also report its configuration parameters through Bluetooth to a connected accessory (e.g., remote, tablet, phone app, and the like) or through Wi-Fi to another device or the cloud, in order to identify what type of furniture or bed the control box is controlling and what capabilities the control box has. By way of example only, the control box may report the number and axis assignments of the actuators connected to the system, and a phone app may use this to show/hide certain graphics or buttons in its user interface for actuators that are connected/disconnected.

Definitions

Having briefly described an overview of aspects of the present disclosure, various terms used throughout this description are provided. Although more details regarding various terms are provided throughout this description, general descriptions of some terms are included below to provide a clearer understanding of the ideas disclosed herein:

Furniture Unit—As used herein, the term "furniture unit" generally refers to a piece of motion furniture (e.g., motorized furniture). Motion furniture includes, without limitation, recliners, lift recliners, incliners, sofas, love seats, sectionals, theater seating, traditional chairs, chairs with a moveable seat portion, motion desks, adjustable beds, split adjustable beds, smart beds, and other such furniture pieces.

Control Box—As used herein, the term "control box" generally refers to one or more computer hardware components configured to operate actuators, such as motors, within various furniture units. A control box may, in some cases, use a standard trapezoidal motion profile to provide a soft-start and a soft-stop during furniture unit repositioning. The control box may use a standard position PID loop with velocity and acceleration feed-forwards to control actuators to a target position.

Master Control Box—As used herein, the term "master control box" generally refers to one or more computer hardware components configured to regulate the repositioning of furniture units by controlling, for example, actuators and other control boxes.

Actuator—As used herein, the term "actuator" generally refers to a type of motor that is responsible for moving or controlling a furniture unit or a portion thereof. An actuator is assigned a virtual axis and a transfer function from a control box or a master control box. The actuator may use an output from the virtual axis and a transfer function to determine a target position.

Communications Bus—As used herein, the term "communications bus" generally refers to one or more computer hardware components used to communicate (e.g., transfer and/or receive data, etc.) to other computer hardware components. By way of example only, a master control box can command (e.g., control) actuators and other control boxes using a communications bus or a network of communication busses.

Virtual Axis—As used herein, the term "virtual axis" is an abstracted linear motion simulation contained in the software and/or memory of the control box. In some embodiments, a virtual axis may have no physical representation and/or analog.

Transfer Function—As used herein, the term "transfer function" generally refers to one or more functions performed by an actuator on an output of a virtual axis to transform the output into a position target for that actuator. In this way, multiple actuators can reference the same virtual axis for synchronization purposes, but use different transfer functions to maintain complex relationships between the positions of various actuators.

Exemplary Synchronization and Repositioning Environment

Turing now to FIG. 1, a schematic depiction is provided illustrating an exemplary synchronization environment 100 in which some embodiments of the present disclosure may be employed. Among other components not shown, synchronization environment 100 may include furniture unit 102, a user device, such as user devices 104A, 104B, and 104C, and data store 106.

Furniture unit 102 includes computing device 110, control boxes 112, actuators 114, sensors 116, busses 118, and master control box 122. Computing device 110 includes drivers 120. Computing device 110 can be a distributed computing device. It should be understood that synchronization environment 100 shown in FIG. 1 is an example of one suitable system. Any of the components shown in FIG. 1 may be implemented via any type of computing device, such as computing device 800 described with reference to FIG. 8, for example. The components may communicate with each other via one or more networks 108, which may include, without limitation, one or more local area networks (LANs) and/or wide area networks (WANs). Such networking environments are commonplace in offices, enterprise-wide computer networks, intranets, and the Internet.

It should be understood that this and other arrangements described herein are set forth only as examples. Other arrangements and elements (e.g., machines, interfaces, functions, orders, groupings of functions, etc.) can be used in addition to or instead of those shown, and some elements may be omitted altogether. Further, many of the elements described herein are functional entities that may be implemented as discrete or distributed components or in conjunction with other components, and in any suitable combination and location. Various functions described herein as being performed by one or more entities may be carried out by hardware, firmware, and/or software. For instance, various functions may be carried out by a processor executing instructions stored in memory.

Generally, synchronization environment 100 facilitates the repositioning of a furniture unit, or a portion thereof, using a plurality of actuators, particularly when the relationship between the actuators is not equal (e.g., inverse, quadratic, inverse square, etc.). User devices 104A to 104C include a variety of devices that can control and communicate with, through Bluetooth, Wi-Fi, or other wired and/or wireless communication means, furniture unit 102 and components included therein. By way of example only, user devices, such as user devices 104A to 104C include buttons on the furniture unit, Bluetooth remotes, phone or tablet applications, home automation systems, Wi-Fi devices, and the like.

Data store 106 generally includes, among other data, memory positions, including user-defined positions and factory-configured positions. Memory position data may include full scenes, including RGB lighting information, massage levels, nose levels, and configuration data. Data store 106 may also include image data, sound data, and the like.

As previously stated, furniture unit 102 includes computing device 110, control boxes 112, actuators 114, sensors 116, busses 118, and master control box 122. Computing device 110 includes drivers 120. Computing device 110 can be a distributed computing device. Master control box 122 is generally configured to maintain the current linear position of each virtual axis of motion in the furniture and coordinates commands for each virtual axis across the communication bus.

A control box, such as Control Boxes 112, consist of multiple H-bridges, which are intended to operate linear actuators. Control Boxes 112, however, are also configured to utilize H-bridges to be used as solid-state switches instead to operate many other types of devices including LEDs, solenoids, external control systems, relays, valves, pumps, etc. without changing the control box hardware. Control boxes 112 are generally configured to assign, to each actuator, a virtual axis via software configuration of the control box. Further, Control Boxes 112 are also configured to assign to each associated actuator, a transfer function. The Control boxes 112 are further configured to detect actuator current draw and to disable motor if current draw is too high. Control boxes 112 support motors with and without Hall sensors via a software configuration option. Control boxes 112 also support various other Hall sensor supply voltages, such as 5V Hall or 12V Hall sensor supply voltages, via a software configuration option.

Control boxes 112 are also configured to perform motor detection. In this regard, control boxes 112 can detect actuator presence and certain actuator faults by pulsing the actuator in both directions and checking measurements of actuator current draw and position.

Control boxes 112 are also configured to perform motor home seek. In this regard, Control boxes 112 can position an actuator exactly at its limit switch by either using a series of pulses to "bump" the motor until it is off the limit switch (if the limit switch is wired in series with the motor) or operating the motor at a reduced speed until the limit switch input is no longer triggered (if the limit switch is wired separately, e.g. as a GPIO).

Control boxes 112 are also configured to perform axis link and unlink functionality. In some cases, it is desired to control axes individually at some times, but synchronized together at others. For instance, in a split bed system, the left side and right side may be synchronized together most of the time, but sometimes one user may want to de-synchronize the lumbar support for one side of the bed and control it separately. Control boxes 112 allow multiple axes to be linked together "on-the-fly" by an end user, and later unlinked.

Control boxes 112 are also configured to perform soft limits. Essentially, the maximum extents of an axis can be set in a control box configuration, and a control box, such as a control box of control boxes 112, will not attempt to drive the axis past these extents (except while homing, where position is not known).

Control boxes 112 are also configured to perform configurable motor polarity. In this sense, software contained on control boxes 112 can flip the motor direction in case it is wired differently from what the control box expects, or is installed in another orientation.

Control boxes 112 are also configured to perform motor lock-out. In this regard, control boxes 112 can temporarily disable one or more actuators, such as actuators 114 of FIG. 1. This may be used by a theater to lock unsold seats and prevent them from being operated.

Control boxes 112 are also configured to perform motor overheat protection. In this way, motor control box, such as a motor control boxes 112 can limit the long-term duty cycle of a motor. For example, the motor may not be rated for continuous operation. By limiting the motor to a few minutes of operation at a time, the motor can be run within its rated duty cycle to prevent overheating.

Control boxes 112 are also configured to perform actuator position recall. In this regard, the current position of each actuator is saved at the completion of each movement, which enables the position to be restored if the control box is powered off and back on, without having to repeat a calibration procedure.

Control boxes 112 are also configured to enable/disable various voltage supplies for the massage motors.

Control boxes 112 are also configured to perform phase control. In this regard, control Boxes 112 support multiple massage motors, which may be configured in wave, pulse, or steady (e.g., normal) modes. Other modes can also be added. The different modes and the phase of the mode are synchronized across multiple control boxes.

Control boxes 112 are also configured to support standard RGB LED lighting and can synchronize the color of the RGB lighting across control boxes.

Control boxes 112 are also configured to perform gamma correction. Essentially, Control Boxes 112 can apply gamma correction to the RGB values to maintain the appearance of colors and provide a more natural translation between RGB and real-world lighting conditions. Moreover, Control boxes 112 are also configured to perform LED color fade. That is, LED colors can be faded from one color to another using a variety of mathematical operations (including direct linear fade, hue-saturation-lightness-based hue fade ("HSV"), off-on fade, etc.).

Control boxes 112 are also configured to perform buzzer tone control. In some embodiments, a buzzer can be commanded with musical piano-key note names (e.g. "C3") and produces the appropriate frequency of those notes. The buzzer can also be commanded to play a sequence of notes to produce a melody.

Control boxes 112 are also configured to prevent certain types of movements (e.g. disallow raising the head-rest until the chair is reclined) which can be used for user comfort/safety or because of mechanism constraints. In some embodiments, an odometer may be used to record the total movement of each actuator and save after each command to provide a movement odometer for each actuator, which can be used for preventive maintenance.

Control boxes 112 are also configured to perform detection circuitry for power input (e.g., 12V regulator, and 3.3V regulator voltages). The voltage can be used to detect a power failure or a switch to battery power and place the control box in low-power mode to maintain clock time or lengthen battery run-time.

Control boxes 112 are also configured to perform movement priority control. Essentially, inputs (e.g., commands) may come from many sources, both external and internal. The priority of these commands can be configured so that, for instance, wired handset commands are prioritized over Bluetooth remote handset commands, which are prioritized over remote Wi-Fi commands. This can ensure that a local user's commands cannot be overridden by another system against the user's will. Control boxes 112 are configured to perform input (e.g., command) prioritization.

Control boxes 112 are also configured to perform mechanism and occupancy sensing. For mechanism sensing, presence or touch can be sensed on the electrically-conductive metal mechanism and used to stop the movement of motors. For occupancy sensing, occupancy detection in a furniture unit (e.g., bed, recliner, chair, etc.) can be used to activate lights, control home automation systems or appliances, or control actuators in the furniture unit.

Control boxes 112 are also configured to perform diagnostics detection and reporting of faults and errors to local or cloud-based services. Diagnostics include power level/power failure information, connection status of all ports (when available for the assigned configuration), current sense and LP Sense readings, software faults, actuator faults, and hardware faults. It should be appreciated that LP Sense is a patented safety-enhancement feature developed by LEGGETT & PLATT of Carthage, Mo., that uses capacitive sensing technology to detect human presence and contact with chair mechanisms or adjustable bed bases. When LP Sense detects human contact with the metal of the furniture mechanism, for example, the motors will stop moving.

Control boxes 112 are also configured to perform configuration. In this regard, nearly all settings and installation options for the various furniture units can be achieved with a single software image, by simply changing the configuration settings in the control box. This eliminates the need for different software to be maintained for different systems.

Control boxes 112 are also configured to receive commands from a Bluetooth remote handset and/or a Bluetooth-enabled phone or tablet.

Control boxes 112 are also configured to connect to a wireless network over Wi-Fi, and receive commands and pass information to/from a cloud server.

Control boxes 112 are also configured to be connected as part of a bus network (e.g., a CAN bus network) to provide control over multiple pieces of furniture. For instance, a set of theater chairs may be wired together in a cinema to provide all-open/all-close features, or connect to a central computer or ticketing system to lock/unlock sold seats or record diagnostic or occupancy information. The chairs only need a single bus cable between them which simplifies wiring over alternative systems such as Ethernet which may require all chairs to be wired to a central networking closet. The CAN bus data can then be read directly by a computer or converted into Ethernet or Wi-Fi by a bridge device, enabling a remote computer to control and monitor the furniture. Further, control boxes of the past required manual device ID assignment when connected on a CAN bus. In contrast, Control boxes 112 use device serial numbers and other information to automatically assign device IDs.

Control boxes 112 are also configured to store and recall tens of memory positions, including several factory-configured preset positions in a data store, such as data store 106 of FIG. 1. The memory position data may also include full scenes, including RGB lighting information, massage levels and configuration.

Control boxes 112 are also configured to include a handset input port with 4 GPIOs. The handset can be configured to use those 4 pins to perform any input/output function available on a control box. By way of example only, 2 of the pins can also be configured as a serial UART interface enabling full system control of the control box via the handset.

Actuators 114 are generally configured to move a furniture unit, or a portion thereof, from a first position to a second position. The repositioning may be based on a master control box, such as master control box 112 receiving an input from a user device, such as user devices 104A-104C.

Sensors 116 generally include various different sensors, such as, for example, a mechanism sensor and an occupancy sensor. By way of example only, mechanism sensors recognize the presence or touch can be sensed on the electrically-conductive metal mechanism and used to stop the movement of motors. Additionally, an occupancy sensor recognizes occupancy in a furniture unit (e.g., bed, chair, sofa, recliner, etc.) can be used to activate lights, control home automation systems or appliances, or control actuators in the furniture.

Buses 118 (e.g., CAN busses; CAN bus network; communication bus) are generally connected between all of the control boxes, as well as between the control boxes, such as control boxes 112, master control box.

Computer device 110, which hosts drivers 120, is configured to communicate with the other components in furniture unit 102. Drivers 120 include a variety of different drivers, including storage drivers, LED drivers, massage motor and tone drivers.

Figure 2:
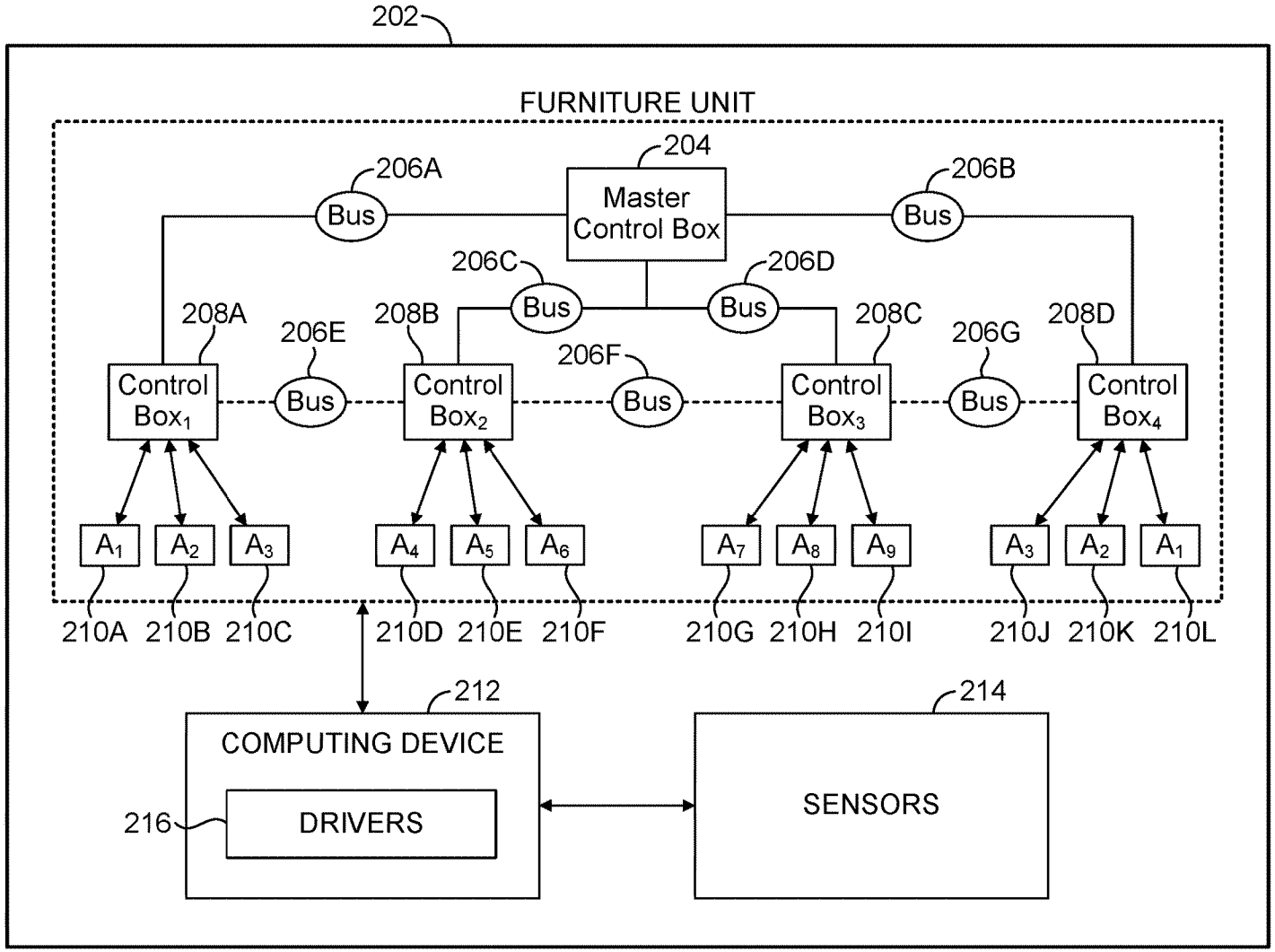
FIG. 2 is a depiction of a furniture unit comprising various components, in accordance with embodiments of the present disclosure.

Turing now to FIG. 2, a depiction of a furniture unit comprising various components, in accordance with embodiments of the present disclosure is shown. Furniture unit 202 includes master control box 204, busses 206A-206G, control boxes 208A-208D, actuators 210A-210L, computing device 212 and sensors 214. It should be appreciated that computing device 212 is in communication with one or more of the hardware components within furniture unit 202, including but not limited to master control box 204, busses 206A-206G, control boxes 208A-208D, actuators 210A-210L, and sensors 214. As described in greater detail elsewhere herein, the components within furniture unit 202 are configured to, based upon receiving an input (e.g., command), reposition the motion furniture from an initial position to a second position.

Exemplary Circuit Diagrams

FIGS. 3 through 6 each provide circuit-level diagrams depicting graphical representations of exemplary electrical circuits for synchronously repositioning a furniture unit, in accordance with embodiments of the present disclosure. Additional circuit-level diagrams depicting graphical representations of exemplary electrical circuits for synchronously repositioning a furniture unit, in accordance with embodiments of the present disclosure, can be found in Appendix A of this application.

Figure 3:
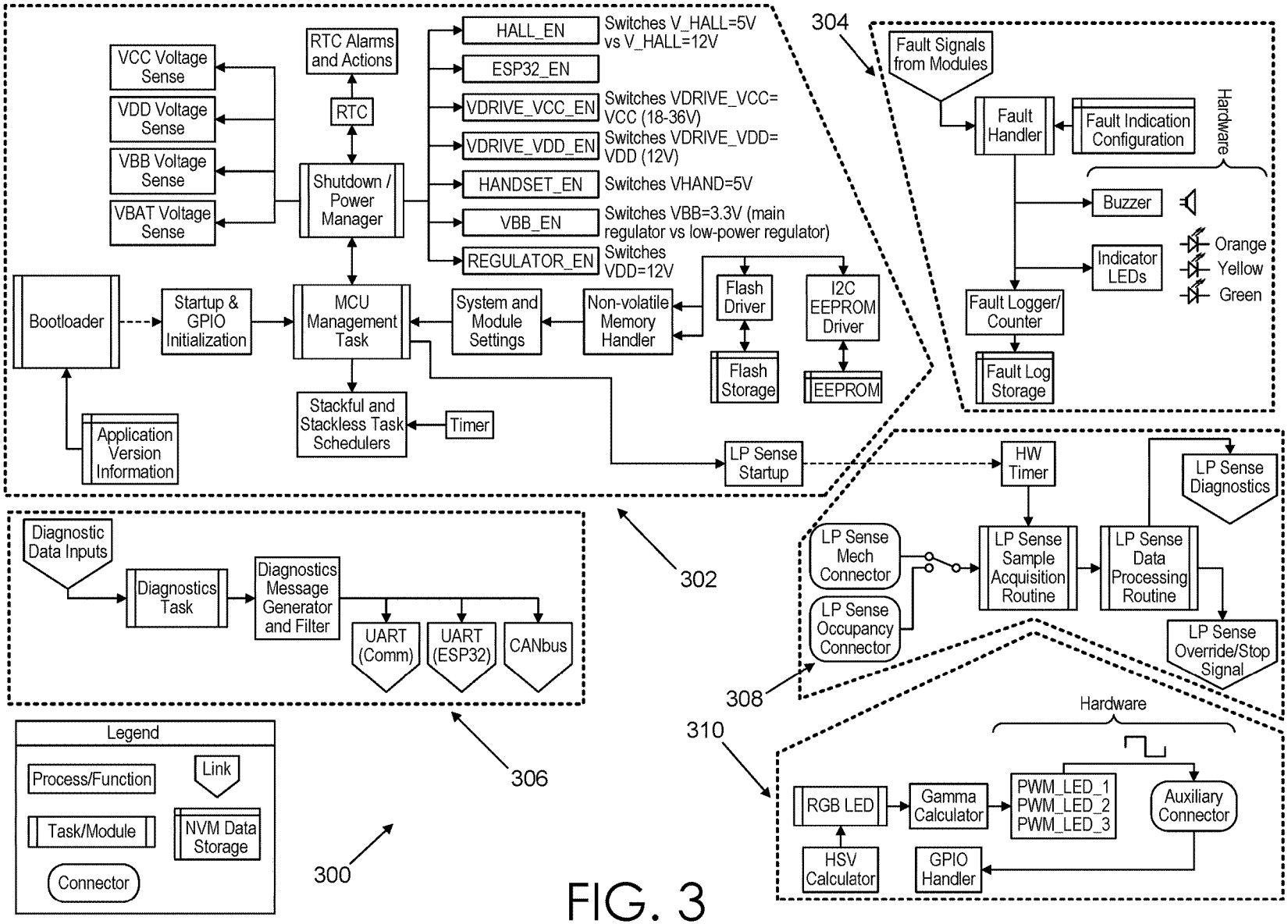
FIG. 3 is a circuit diagram depicting a graphical representation of an exemplary electrical circuit for repositioning a furniture unit, in accordance with embodiments of the present disclosure.

Specifically referring to FIG. 3, circuit 300 includes general block 302, peripheral block 304, diagnostics block 306, sense data block 308, and LED block 310. General block 302 includes various types of non-volatile memory, various types of voltage supplies, at least one microprocessor unit, various drivers, and a real-time clock. Peripheral block 304 includes hardware components such as a buzzer and LED light indicators, both for indicating fault (e.g., damage, malfunction, etc.). Diagnostics block 306 includes various modules, functions, receiver transmitters, and communication busses related to diagnostics. LED block 310 includes modules, functions, and connectors for generally directed to the functioning of LED lights.

Figure 4:
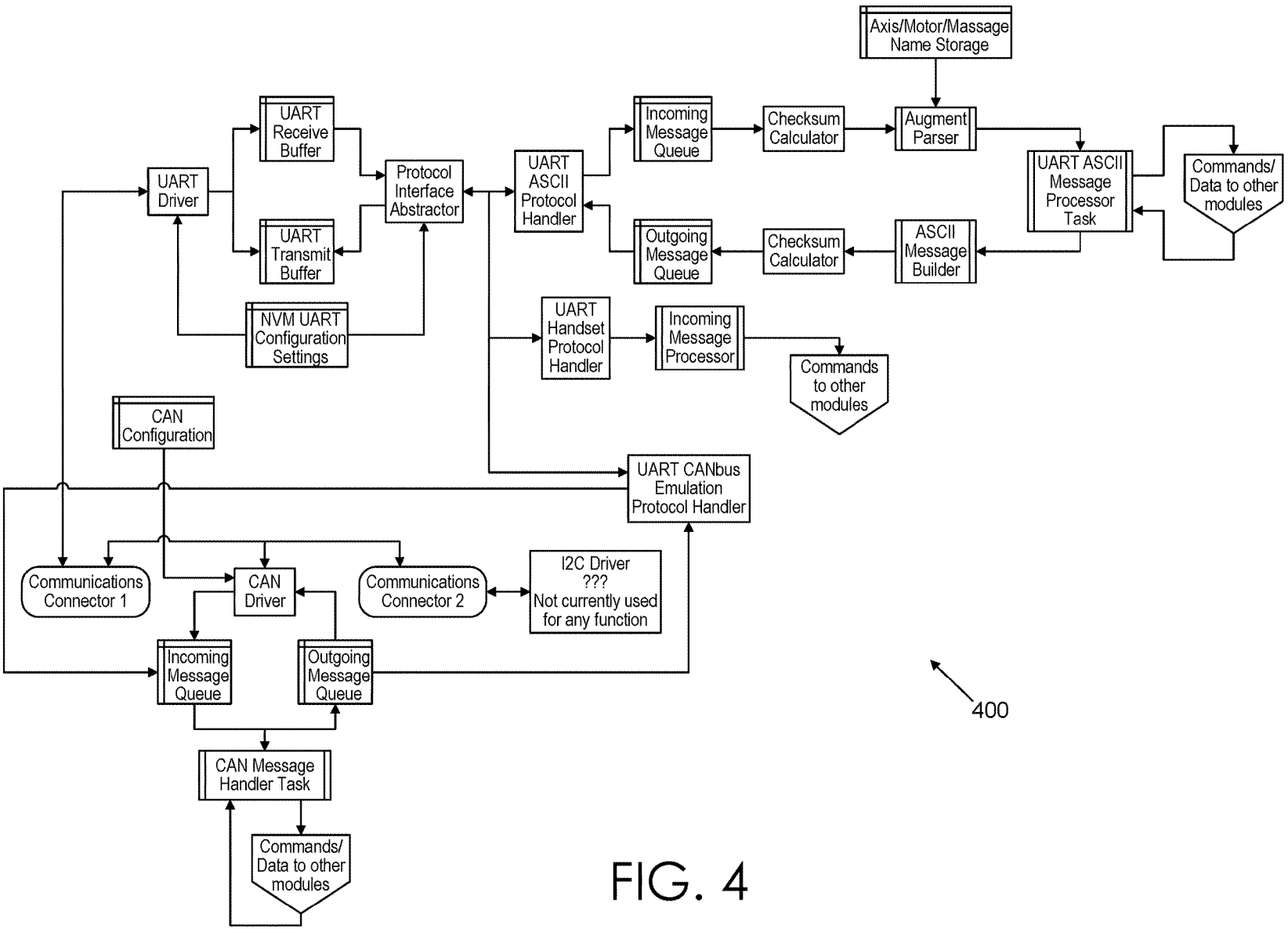
FIG. 4 is a circuit diagram depicting a graphical representation of an exemplary electrical circuit for repositioning a furniture unit, in accordance with embodiments of the present disclosure.

Turing now to FIG. 4, circuit 400 generally depicts the receiving and sending of an input (e.g., command) to other modules within the circuit via a CAN bus.

Figure 5:
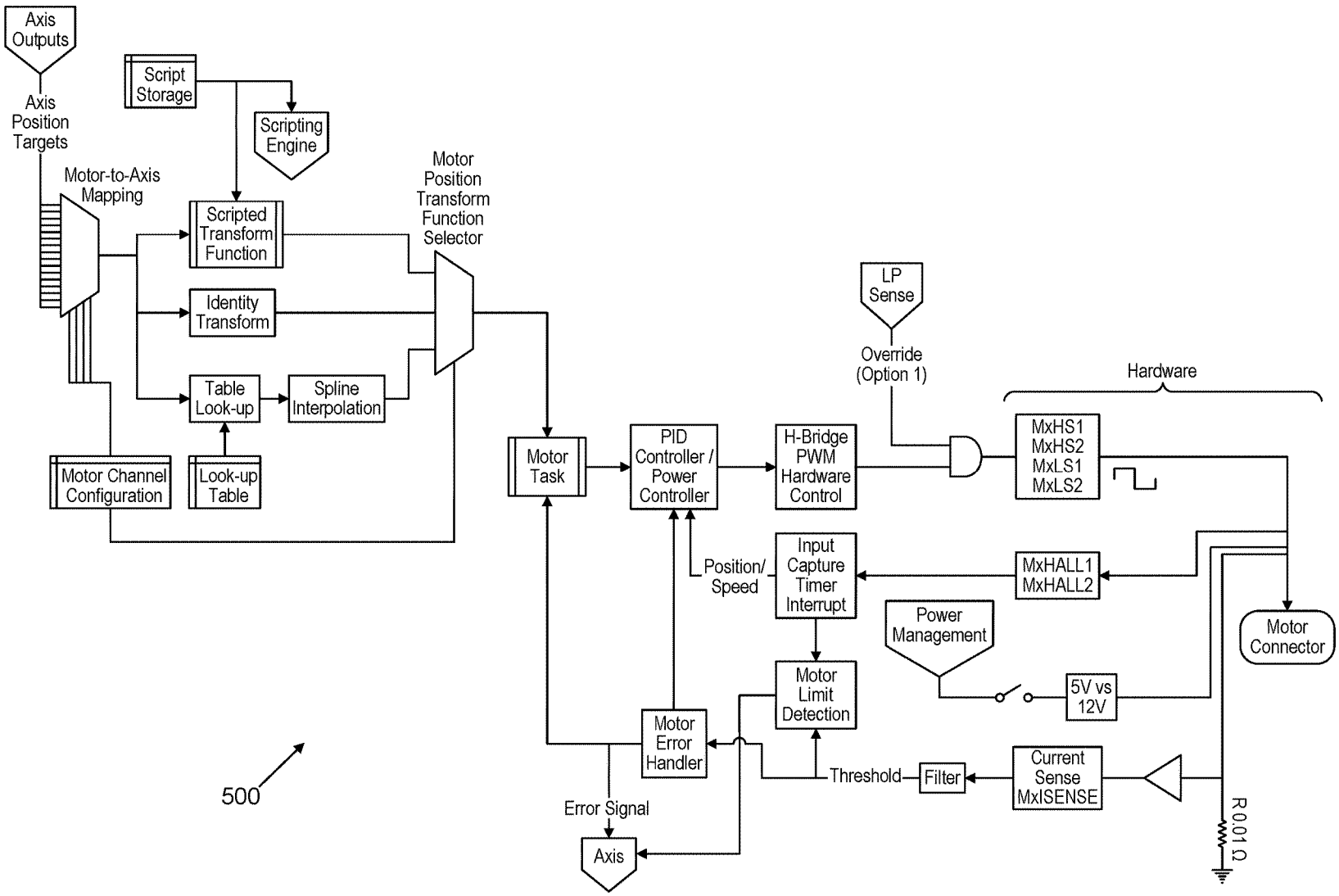
FIG. 5 is a circuit diagram depicting a graphical representation of an exemplary electrical circuit for repositioning a furniture unit, in accordance with embodiments of the present disclosure.

Turning now to FIG. 5, circuit 500 generally depicts the process of applying a transfer function to a virtual axis output to reposition a furniture unit.

Figure 6:
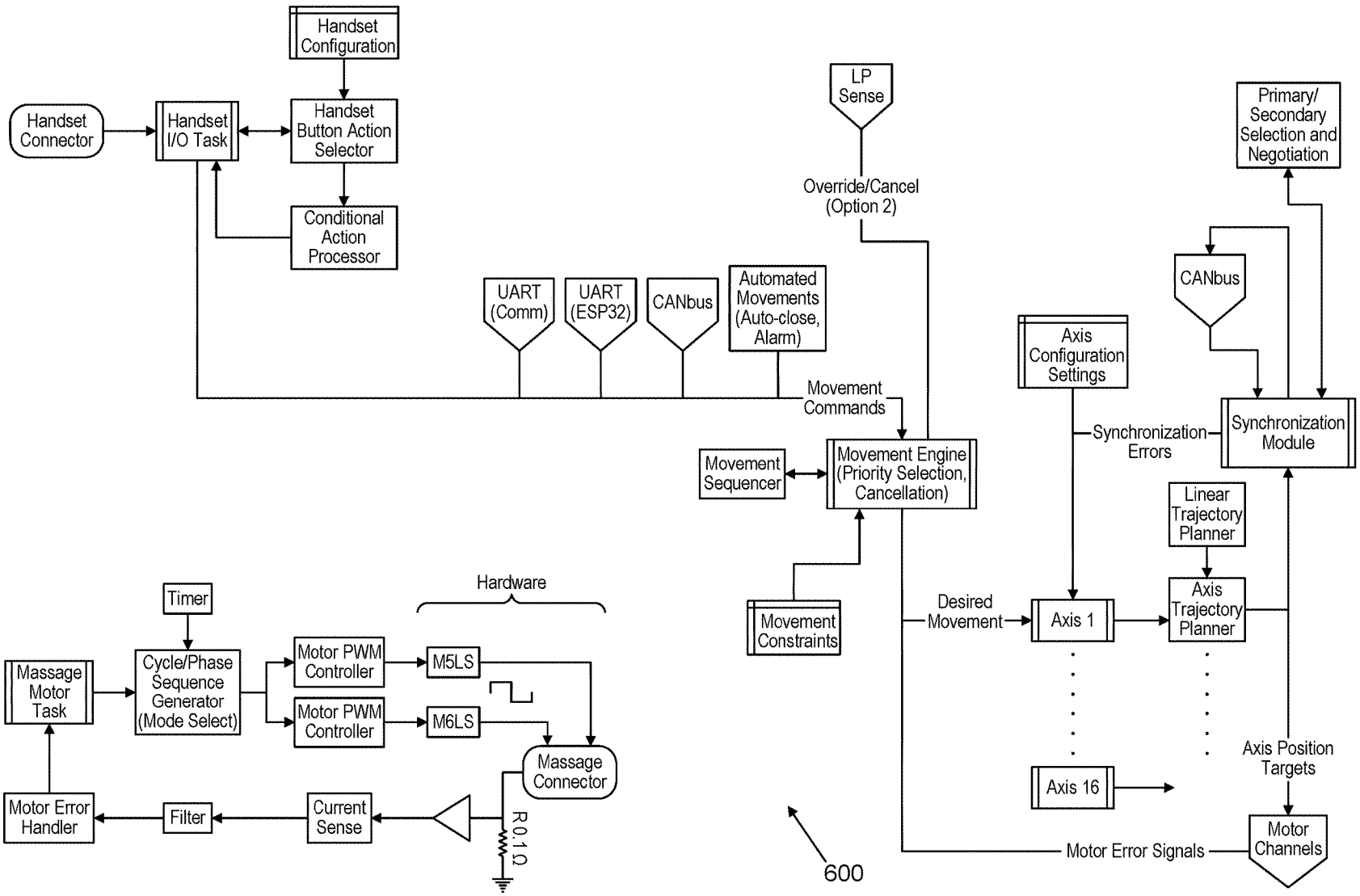
FIG. 6 is a circuit diagram depicting a graphical representation of an exemplary electrical circuit for repositioning a furniture unit, in accordance with embodiments of the present disclosure.

Turning now to FIG. 6, circuit 600 depicts receiving an input from a handset and transforming it into a movement. FIG. 6 also depicts the massage connector process.

Exemplary Method

Figure 7:
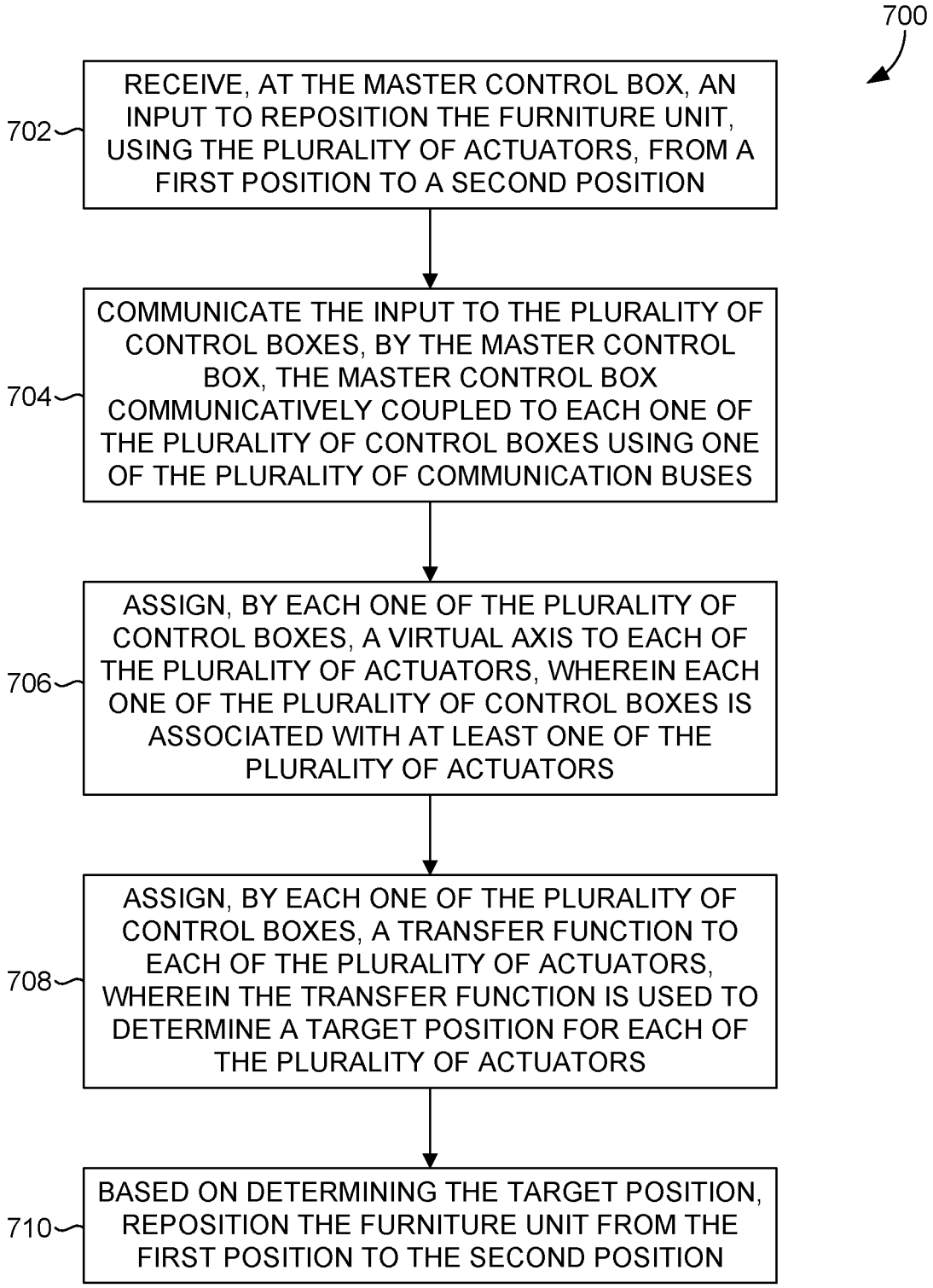
FIG. 7 is a flow diagram showing an example method for repositioning a furniture unit, in accordance with embodiments of the present disclosure.

FIG. 7 provides a flow diagram showing an example method for repositioning a furniture unit, in accordance with embodiments of the present disclosure. Initially, and as indicated at block 702, a master control box receives an input to reposition the furniture unit, using the plurality of actuators, from a first position to a second position. At block 704 the master control box communicates the input to the plurality of control boxes using at least one of the plurality of communication busses. At block 706 each one of the plurality of control boxes assigns a virtual axis to each of the plurality of actuators, where each one of the plurality of control boxes is associated with at least one of the plurality of actuators. At block 708, each one of the plurality of control boxes assigns a transfer function to each of the plurality of actuators, where the transfer function is used to determine a target position for each of the plurality of actuators. Finally, at block 710, based on determining the target position, repositioning the furniture unit from the first position to the second position.

Exemplary Operating Environment

Figure 8:
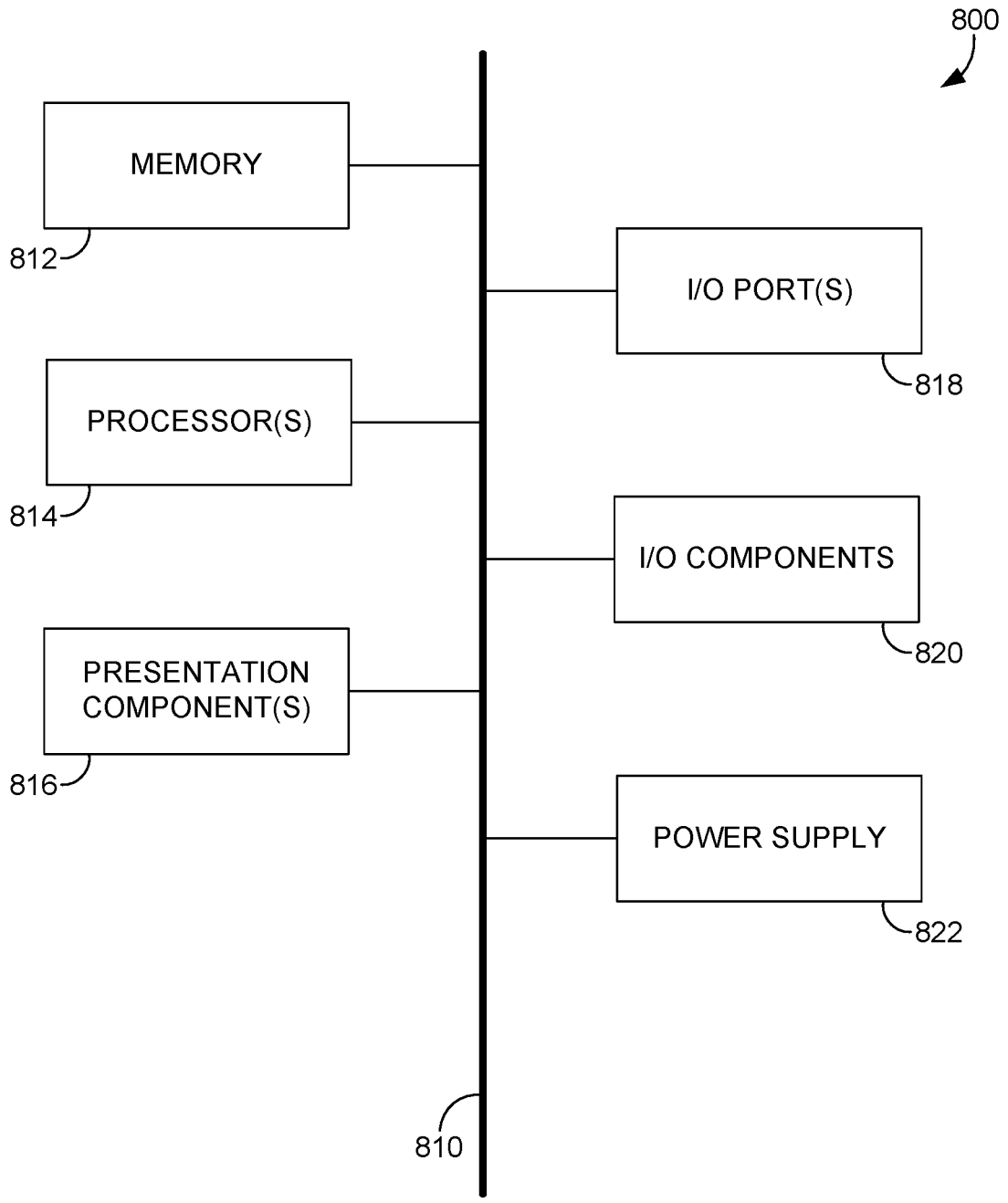
FIG. 8 is a block diagram of an exemplary computing environment suitable for use in implementing embodiments of the present disclosure.

Having described an overview of embodiments of the present invention, an exemplary operating environment in which embodiments of the present invention may be implemented is described below in order to provide a general context for various aspects of the present invention. Referring now to FIG. 8 in particular, an exemplary operating environment for implementing embodiments of the present invention is shown and designated generally as computing device 800. Computing device 800 is but one example of a suitable computing environment and is not intended to suggest any limitation as to the scope of use or functionality of the invention. Neither should computing device 800 be interpreted as having any dependency or requirement relating to any one or combination of components illustrated.

The invention may be described in the general context of computer code or machine-useable instructions, including computer-executable instructions such as program modules, being executed by a computer or other machine, such as a cellular telephone, personal data assistant or other handheld device. Generally, program modules including routines, programs, objects, components, data structures, etc., refer to code that perform particular tasks or implement particular abstract data types. The invention may be practiced in a variety of system configurations, including hand-held devices, consumer electronics, general-purpose computers, more specialty computing devices, etc. The invention may also be practiced in distributed computing environments where tasks are performed by remote-processing devices that are linked through a communications network.

With reference to FIG. 8, computing device 800 includes bus 810 that directly or indirectly couples the following devices: memory 812, one or more processors 814, one or more presentation components 816, input/output (I/O) ports 818, input/output components 820, and illustrative power supply 822. Bus 810 represents what may be one or more busses (such as an address bus, data bus, or combination thereof). Although the various blocks of FIG. 8 are shown with lines for the sake of clarity, in reality, delineating various components is not so clear, and metaphorically, the lines would more accurately be grey and fuzzy. For example, one may consider a presentation component such as a display device to be an I/O component. Also, processors have memory. The inventor recognizes that such is the nature of the art, and reiterates that the diagram of FIG. 8 is merely illustrative of an exemplary computing device that can be used in connection with one or more embodiments of the present invention. Distinction is not made between such categories as "workstation," "server," "laptop," "hand-held device," etc., as all are contemplated within the scope of FIG. 8 and reference to "computing device."

Computing device 800 typically includes a variety of computer-readable media. Computer-readable media can be any available media that can be accessed by computing device 800 and includes both volatile and nonvolatile media, and removable and non-removable media. By way of example, and not limitation, computer-readable media may comprise computer storage media and communication media. Computer storage media includes both volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computing device 800. Computer storage media does not comprise signals per se. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer-readable media.

Memory 812 includes computer-storage media in the form of volatile and/or nonvolatile memory. The memory may be removable, non-removable, or a combination thereof. Exemplary hardware devices include solid-state memory, hard drives, optical-disc drives, etc. Computing device 800 includes one or more processors that read data from various entities such as memory 812 or I/O components 820. Presentation component(s) 816 present data indications to a user or other device. Exemplary presentation components include a display device, speaker, printing component, vibrating component, etc.

I/O ports 818 allow computing device 800 to be logically coupled to other devices including I/O components 820, some of which may be built in. Illustrative components include a microphone, joystick, game pad, satellite dish, scanner, printer, wireless device, etc. The I/O components 820 may provide a natural user interface (NUI) that processes air gestures, voice, or other physiological inputs generated by a user. In some instances, inputs may be transmitted to an appropriate network element for further processing. An NUI may implement any combination of speech recognition, stylus recognition, facial recognition, biometric recognition, gesture recognition both on screen and adjacent to the screen, air gestures, head and eye tracking, and touch recognition (as described in more detail below) associated with a display of computing device 800. Computing device 800 may be equipped with depth cameras, such as stereoscopic camera systems, infrared camera systems, RGB camera systems, touchscreen technology, and combinations of these, for gesture detection and recognition. Additionally, the computing device 800 may be equipped with accelerometers or gyroscopes that enable detection of motion. The output of the accelerometers or gyroscopes may be provided to the display of computing device 800 to render immersive augmented reality or virtual reality.

Having identified various components in the present disclosure, it should be understood that any number components and arrangements may be employed to achieve the desired functionality within the scope of the present disclosure. For example, the components in the embodiments depicted in the figures are shown with lines for the sake of conceptual clarity. Other arrangements of these and other components may also be implemented. For example, although some components are depicted as single components, many of the elements described herein may be implemented as discrete or distributed components or in conjunction with other components, and in any suitable combination and location. Some elements may be omitted altogether. Moreover, various functions described herein as being performed by one or more entities may be carried out by hardware, firmware, and/or software, as described below. For instance, various functions may be carried out by a processor executing instructions stored in memory. As such, other arrangements and elements (e.g., machines, interfaces, functions, orders, and groupings of functions, etc.) can be used in addition to or instead of those shown.

The subject matter of the present invention is described with specificity herein to meet statutory requirements. However, the description itself is not intended to limit the scope of this patent. Rather, the inventor has contemplated that the claimed subject matter might also be embodied in other ways, to include different steps or combinations of steps similar to the ones described in this document, in conjunction with other present or future technologies. Moreover, although the terms "step" and/or "block" may be used herein to connote different elements of methods employed, the terms should not be interpreted as implying any particular order among or between various steps herein disclosed unless and except when the order of individual steps is explicitly described.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages, which are obvious and inherent to the system and method. It will be understood that certain features and subcombinations are of utility and may be employed without reference to other features and subcombinations. This is contemplated by and is within the scope of the claims.

What is claimed is:

1. A system comprising a furniture unit operably coupled to a plurality of control boxes, a master control box, a plurality of actuators, a plurality of sensors, a plurality of communication busses, and at least one computing device, the system configured to perform a method for repositioning the furniture unit comprising the steps of:

receiving, at the master control box, an input to reposition the furniture unit, using the plurality of actuators, from a first position to a second position;

communicating the input to the plurality of control boxes, by the master control box, the master control box communicatively coupled to each one of the plurality of control boxes using one of the plurality of communication busses;

assigning, by each one of the plurality of control boxes, a virtual axis to each of the plurality of actuators, wherein each one of the plurality of control boxes is associated with at least one of the plurality of actuators;

assigning, by each one of the plurality of control boxes, a transfer function to each of the plurality of actuators, wherein the transfer function is used to determine a target position for each of the plurality of actuators; and based on determining the target position, repositioning the furniture unit from the first position to the second position.

2. The system of claim 1, wherein the master control box maintains a current linear position of each virtual axis associated with the furniture unit.

3. The system of claim 1, wherein based on the input the master control box coordinates a plurality of commands for the virtual axis assigned to each of the plurality of actuators, the coordinating occurring using the plurality of communication busses, the plurality of communication busses connecting the plurality of control boxes.

4. The system of claim 1, wherein the input is provided by an external source, the external source comprising buttons on the furniture unit, Bluetooth remotes, phones, tablets, home automation systems, Wi-Fi devices, or a combination thereof.

5. The system of claim 1, wherein the input is provided by an internal source, the internal source comprising decisions based on furniture unit occupancy, user detection, Bluetooth device proximity, Wi-Fi device proximity, or a combination thereof.

6. The system of claim 1, wherein the virtual axis is an abstracted linear motion simulation.

7. The system of claim 1, wherein determining the target position is further based on an output associated with the virtual axis assigned to each of the plurality of actuators.

8. The system of claim 1, wherein the master control box further controls a plurality of massage motors.

9. The system of claim 1, wherein the master control box further controls light emitting diode (LED) lights, the master control box configured to support LED synchronization and Gamma correction.

10. A system comprising a furniture unit operably coupled to a plurality of control boxes, a master control box, a plurality of actuators, a plurality of sensors, a plurality of communication busses, and at least one computing device, the system configured to perform a method for repositioning the furniture unit comprising the steps of:

receiving, at the master control box, an input to reposition the furniture unit, using the plurality of actuators, from a first position to a second position;

communicating the input to the plurality of control boxes, by the master control box, the master control box communicatively coupled to each one of the plurality of control boxes using one of the plurality of communication busses;

assigning, by each one of the plurality of control boxes, a virtual axis to each of the plurality of actuators, wherein the virtual axis assigned to each of the plurality of actuators is the same virtual axis, wherein the virtual axis is an abstracted linear motion simulation, wherein the master control box maintains a current linear position of each virtual axis associated with the furniture unit, wherein each one of the plurality of control boxes is associated with at least one of the plurality of actuators;

assigning, by each one of the plurality of control boxes, a transfer function to each of the plurality of actuators;

determining a target position for each of the plurality of actuators using the transfer function and an output associated with the virtual axis assigned to each of the plurality of actuators; and based on determining the target position, repositioning the furniture unit from the first position to the second position, wherein based on the input the master control box coordinates a plurality of commands for the virtual axis assigned to each of the plurality of actuators, the coordinating occurring using the plurality of communication busses, the plurality of communication busses connecting the plurality of control boxes.

11. The system of claim 10, wherein the input is provided by an external source, the external source comprising buttons on the furniture unit, Bluetooth remotes, phones, tablets, home automation systems, Wi-Fi devices, or a combination thereof.

12. The system of claim 10, wherein the input is provided by an internal source, the internal source comprising decisions based on furniture unit occupancy, user detection, Bluetooth device proximity, Wi-Fi device proximity, or a combination thereof.

13. The system of claim 10, wherein the master control box disallows certain movements of at least one of the plurality of actuators until at least another one of the plurality of actuators is in a predetermined position.

14. The system of claim 10, wherein the master control box further controls a plurality of massage motors.

15. The system of claim 10, wherein the master control box further controls light emitting diode (LED) lights, the master control box configured to support LED synchronization and Gamma correction.

16. The system of claim 10, wherein the master control box further controls motor lock-out which temporarily disables one or more actuators.

17. The system of claim 10, wherein the master control box further controls an actuator position recall function that, without repeating any calibration procedures, restores previous positions of the plurality of actuators if the control box is powered off and then back on.

18. A furniture unit comprising:

a plurality of control boxes;

a master control box;

a plurality of actuators, wherein each one of the plurality of control boxes is associated with at least one of the plurality of actuators;

a plurality of sensors;

a plurality of communication busses connecting the plurality of control boxes, wherein the master control box is communicatively coupled to each one of the plurality of control boxes using one of the plurality of communication busses;

at least one computing device; and a system operably coupled to the plurality of control boxes, the master control box, the plurality of actuators, the plurality of sensors, the plurality of communication busses, and the at least one computing device, the system configured to perform a method for repositioning the furniture unit comprising the steps of:

receiving, at the master control box, an input to reposition the furniture unit, using the plurality of actuators, from a first position to a second position, communicating the input to the plurality of control boxes, by the master control box, assigning, by each one of the plurality of control boxes, a virtual axis to each of the plurality of actuators, wherein the virtual axis is an abstracted linear motion simulation, assigning, by each one of the plurality of control boxes, a transfer function to each of the plurality of actuators, wherein the transfer function is used to determine a target position for each of the plurality of actuators, and based on determining the target position, repositioning the furniture unit from the first position to the second position.

19. The furniture unit of claim 18, wherein the master control box maintains a current linear position of each virtual axis associated with the furniture unit.

20. The furniture unit of claim 18, wherein based on the input the master control box coordinates a plurality of commands for the virtual axis assigned to each of the plurality of actuators, the coordinating occurring using the plurality of communication busses.

* * * * *